United States Patent [19]

Bryan et al.

[11] Patent Number: 4,679,293

[45] **Date of Patent: *Jul. 14, 1987**

[54] METHOD OF MAKING A RAILROAD TRACK INSULATOR UNIT

[75] Inventors: James S. Bryan, Clyde; Roger D. Meadows, Waynesville, both of N.C.

[73] Assignee: Dayco Products, Inc., Dayton, Ohio

[*] Notice: The term of this patent subsequent to Feb. 11, 2003, has been disclaimed.

[21] Appl. No.: 804,726

[22] Filed: Dec. 5, 1985

Related U.S. Application Data

[62] Division of Ser. No. 531,120, Sep. 9, 1983, Pat. No. 4,569,477.

[51] Int. Cl.[4] ..... B23P 11/02

[52] U.S. Cl. ..... 29/450; 29/453; 29/469.5; 238/349

[58] Field of Search ..... 29/469.5, 515, 450, 29/453; 238/349, 351, 338, 310

[56] References Cited

U.S. PATENT DOCUMENTS

| | | | |
|---|---|---|---|
| 2,009,309 | 7/1935 | Davies et al. | 238/349 X |
| 3,460,756 | 8/1969 | Sanson | 238/349 X |
| 4,030,185 | 6/1977 | Hahm et al. | 29/469.5 X |
| 4,274,582 | 6/1981 | Fee | 238/349 |
| 4,437,916 | 3/1984 | Adell | 29/469.5 X |

FOREIGN PATENT DOCUMENTS

| | | | |
|---|---|---|---|
| 1496390 | 12/1977 | United Kingdom | 238/349 |

*Primary Examiner*—Charlie T. Moon
*Attorney, Agent, or Firm*—Joseph V. Tassone

[57] ABSTRACT

A railroad track insulator, part therefor and methods of making the same are provided, the railroad track insulator being adapted to hold a railroad rail against its foundation and comprising the combination of a metallic part and a polymeric part secured together so that the polymeric part is adapted to engage the rail. The metallic part has an open ended recess in one of the opposed sides thereof and is defined by a peripheral flange arrangement thereof. The polymeric part has a peripheral edge and is disposed and secured in the recess so as to have the peripheral edge thereof supported by the peripheral flange arrangement of the metallic part.

7 Claims, 15 Drawing Figures

METHOD OF MAKING A RAILROAD TRACK INSULATOR UNIT

This is a division, of application Ser. No. 531,120, filed Sept. 9, 1983 now U.S. Pat. No. 4,569,477.

BACKGROUND OF THE INVENTION

1. Field of the Invention

This invention relates to an improved railroad track insulator for holding a railroad rail against its foundation means, a part for such insulator and a method of making the same.

2. Prior Art Statement

It is known to provide a railroad track insulator for holding a railroad rail against its foundation means and comprising the combination of a metallic part and a polymeric part secured together so that the polymeric part is adapted to engage the rail. For example, see the HD-10 insulator of Pandrol Inc. disclosed on Page 66 of the March 1983 Railroad Track and Structures Magazine and the U.S. patent to Serafin et al, U.S. Pat. No. 3,784,098.

It is also known to provide an anchor means having a clip for resiliently engaging against the railroad track insulator as provided in the U.S. patent to Houghton, U.S. Pat. No. 3,920,183 and have the railroad track insulator formed from a single piece of reinforced plastic material as provided in the U.S. patent to Seeley, U.S. Pat. No. 4,104,483.

SUMMARY OF THE INVENTION

It is one feature of this invention to provide an improved railroad track insulator wherein the polymeric part thereof encounters only compressive stress during the use thereof.

In particular, it was found according to the teachings of this invention that the polymeric part of a railroad track insulator could be supported around its entire peripheral edge means by the metallic part of the track insulator so that the polymeric part would only encounter compressive stress during the use thereof as the metallic part would withstand most of the service abuse such as tensile impacts, abrasions, etc. It was also found that should the polymeric part of the railroad track insulator of this invention crack in service, it would still be held in place by the metallic part whereby it is believed that a significantly longer service life would be provided for the railroad track insulator for this invention.

For example, one embodiment of this invention provides a railroad track insulator for holding a railroad rail against its foundation means and comprising the combination of a metallic part having opposed sides and a polymeric part secured together so that the polymeric part is adapted to engage the rail. The metallic part has an open ended recess means in one of the opposed sides thereof and is defined by a peripheral flange means thereof. The polymeric part has a peripheral edge means and is disposed and secured in the recess means so as to have the peripheral edge means thereof supported by the peripheral flange means of the metallic part.

Accordingly, it is an object of this invention to provide an improved railroad track insulator having one or more of the novel features of this invention as set forth above or hereinafter shown or described.

Another object of this invention is to provide an improved metallic part for a railroad track insulator, the metallic part of this invention having one or more of the novel features of this invention as set forth above or hereinafter shown or described.

Another object of this invention is to provide an improved method of making such a railroad track insulator, the method of this invention having one or mroe of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
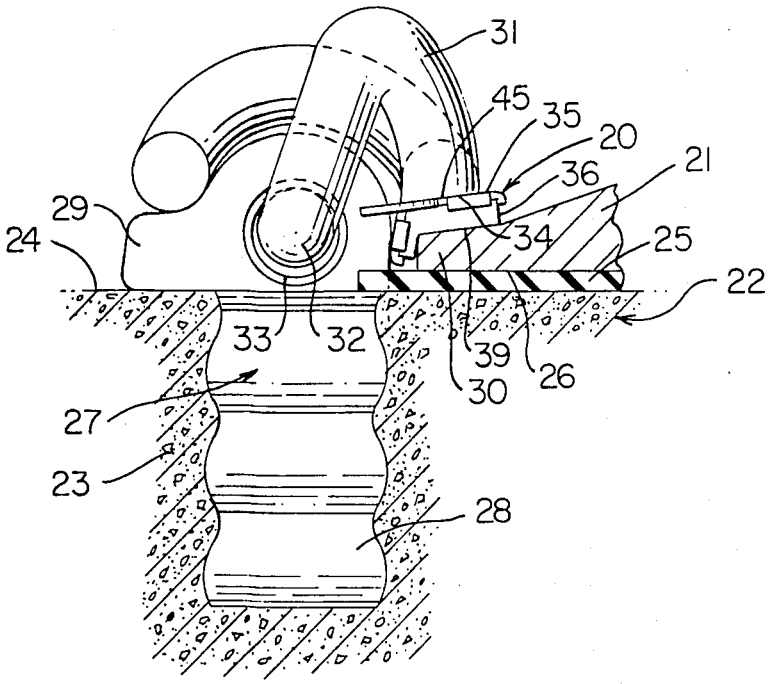
FIG. 1 is a fragmentary cross-sectional view illustrating the improved railroad track insulator of this invention being utilized for holding a railroad rail against its foundation means.

While the various features of this invention are hereinafter illustrated and described as providing a railroad track insulator particularly adapted to be utilized with a particular anchoring means, it is to be understood that the various features of this invention can be used singly or in any combination thereof to provide a railroad track insulator to be utilized with other anchoring means as desired.

Therefore, this invention is not to be limited to only the embodiments illustrated in the drawings, because the drawings are merely utilized to illustrate one of the wide variety of uses of this invention.

Figure 2:
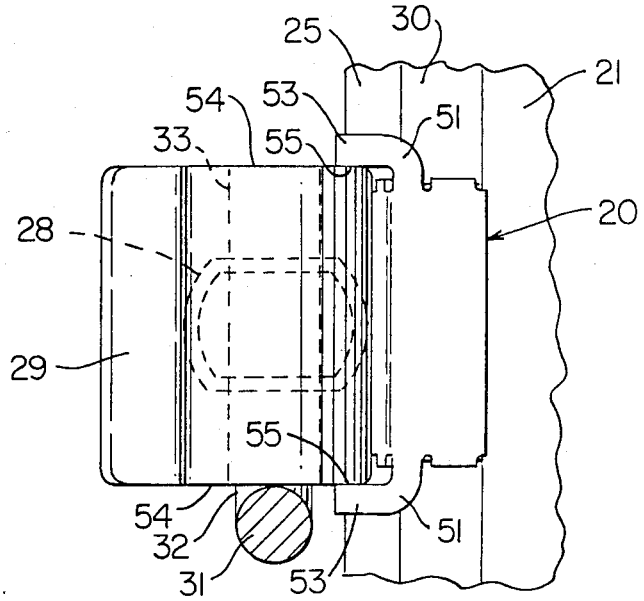
FIG. 2 is a fragmentary top view of the structure illustrated in FIG. 1.

Referring now to FIGS. 1 and 2, the improved railroad track insulator of this invention is generally indicated by the reference numeral 20 and is illustrated as holding a railroad rail 21 against its foundation means that is generally indicated by the reference numeral 22 in a manner fully set forth in the aforementioned U.S. patent to Houghton, U.S. Pat. No. 3,920,183 whereby this U.S. patent is being incorporated into this disclosure by this reference thereto.

The foundation means 22 can comprise a concrete railway sleeper or tie 23 having an upper substantially flat surface 24 on which a rubber pad 25 is laid and against which the bottom surface 26 of the rail 21 is disposed.

An anchor means that is generally indicated by the reference numeral 27 in FIGS. 1 and 2 is carried by the concrete means 23 and has a portion 28 embedded therein so as to hold a substantially rectangular block 29 thereof against the upper surface 24 adjacent to an end flange 30 of the railroad track or rail 21 in a manner well known in the art.

A clip member 31 is carried by the block 29 and has a part 32 disposed in an opening 33 passing through the block 29 while a flattened surface 34 thereof engages against the top of the railroad track insulator 20 to resiliently hold the track insulator 20 against the flange 30 of the railroad rail 21 and thereby hold the railroad rail 21 in place on the support means 23 in a manner well kwown in the art.

As previously stated, it is known to form a railroad track insulator by combining a metallic part with a polymeric part so that only the polymeric part engages the railroad rail in order to electrically insulate the same from the metallic clip 31.

Also as previously stated, it is one feature of this invention to provide an improved railroad track insulator made from a metallic part and a polymeric part.

In particular, the improved railroad track insulator 20 of this invention is best illustrated in FIGS. 3–8 and comprises a metallic part 35 and a polymeric part 36, the metallic part 35 having opposed sides 37 and 38 and the polymeric part 36 having opposed sides 39 and 40 with the sides 37 and 40 of the respective parts 35 and 36 being secured together in any suitable manner, such as with a suitable adhesive means (not shown) in a manner well known in the art.

Figure 4:
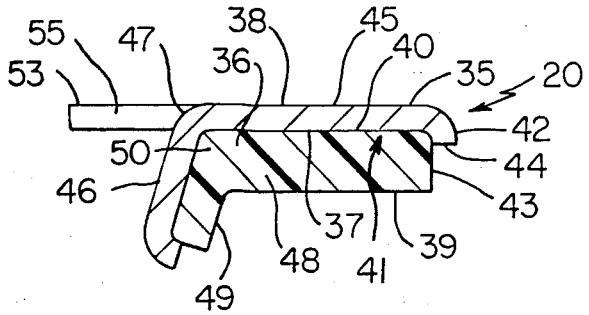
FIG. 4 is a cross-sectional view taken on line 4—4 of FIG. 3.
Figure 7:
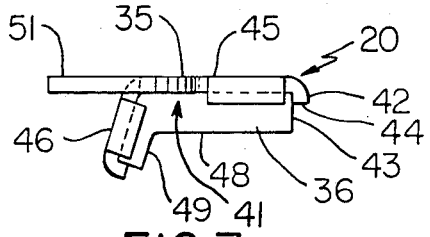
FIG. 7 is a side view of the railroad track insulator of FIG. 3.
Figure 6:
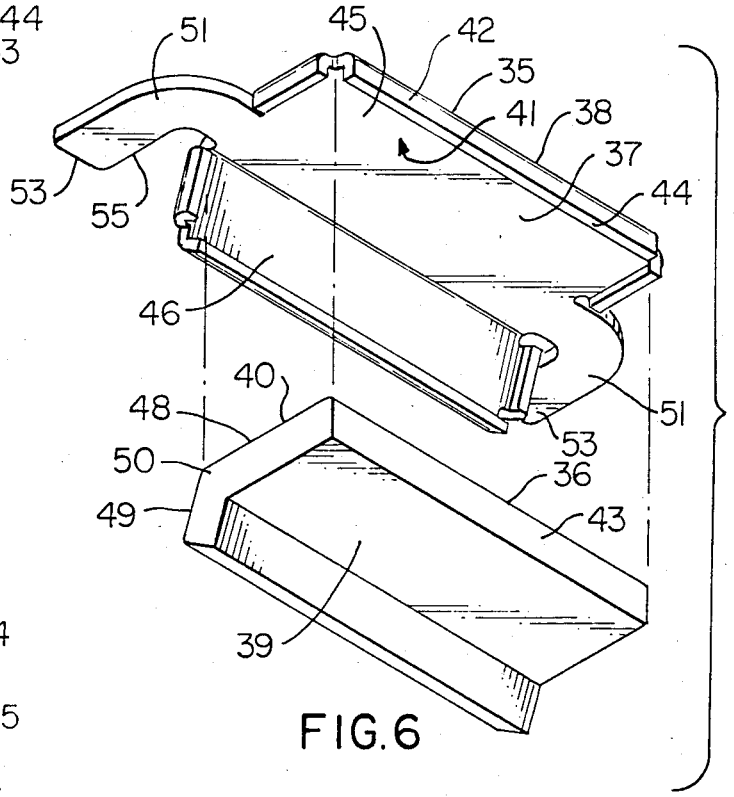
FIG. 6 is an exploded perspective view of the parts that form the railroad track insulator of FIG. 3.
Figure 8:
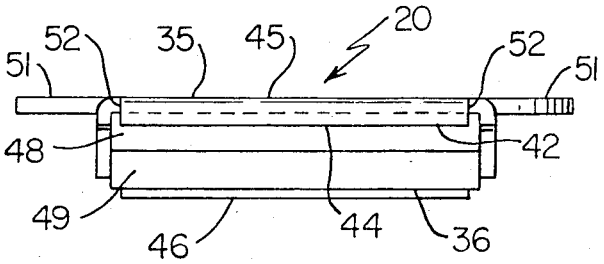
FIG. 8 is a rear view of the railroad track insulator of FIG. 3.
Figure 9:
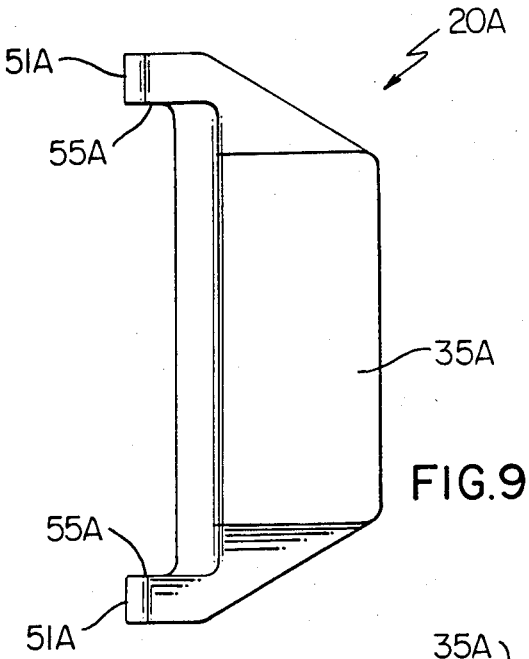
FIG. 9 is a top view of another railroad track insulator of this invention.

The metallic part 35 is provided with a recess means 41 in the side 37 thereof with the recess means 41 being substantially defined by a peripheral flange means 42 which extends from the side 37 and is adapted to support the peripheral edge means 43 of the polymeric part 36 when the polymeric part 36 is disposed and secured in the recess means 41 in the manner illustrated in FIGS. 4, 7 and 8. The peripheral edge means 43 of the polymeric part 36 is disposed between the opposed sides 39 and 40 thereof and the peripheral flange means 42 of the metallic part 35 has an end surface means 44 that is disposed intermediate the opposed sides 40 and 39 of the polymeric part 36 whereby the side 39 of the polymeric part 36 is disposed spaced from the end surface means 44 of the metallic part 35 and thereby is adapted to electrically insulate the metallic part 35 from the railroad rail 21 as the surface or side 39 of the polymeric part 36 is disposed thereagainst as illustrated in FIG. 1.

The metallic part 35 has a substantially L-shaped cross-sectional configuration as illustrated in FIG. 4 which is defined by two legs 45 and 46 angled relative to each other with the legs 45 and 46 being substantially straight or flat and being integrally interconnected by an elbow portion 47.

Similarly, the polymeric part 36 has a substantially L-shaped cross-sectional configuration defined by two legs 48 and 49 that are substantially straight or flat and are integrally joined together by an elbow portion 50, the legs 48 and 49 of the polymeric part 36 generally following the profile of the respective legs 45 and 46 of the metallic part 35 so that the side 40 of the polymeric part 36 conforms to the side 37 of the metallic part 35 as illustrated in FIG. 4.

The substantially flat leg 45 of the metallic part 35 is adapted to be engaged by the flat surface 34 of the clip 31 as illustrated in FIG. 1 so as to hold the side 39 of the polymeric part 36 against the flange 30 of the rail 21 as illustrated in FIG. 1 whereby it can be seen that the polymeric part 36 electrically insulates the rail 21 from the clip 31 for the reasons previously set forth.

However, it can also be seen that the peripheral flange means 42 of the metallic part 35 fully support the peripheral edge means 43 of the polymeric part 36 substantially completely around the same so that the polymeric part 36 encounters only compressive stresses during use of the insulator 20 while the metallic part 35 thereof withstands most of the service abuse, such as tensile impacts, abrasions, etc., and should the polymeric part 36 crack while in service, the cracked polymeric part 36 will still be held in place by the metallic part 35 through its peripheral flange means 42 so that, in effect, a failure has not necessarily occurred whereby it is believed that a significantly longer service life will be provided by the improved railroad track insulator 20 of this invention over the service life of prior known devices.

Figure 3:
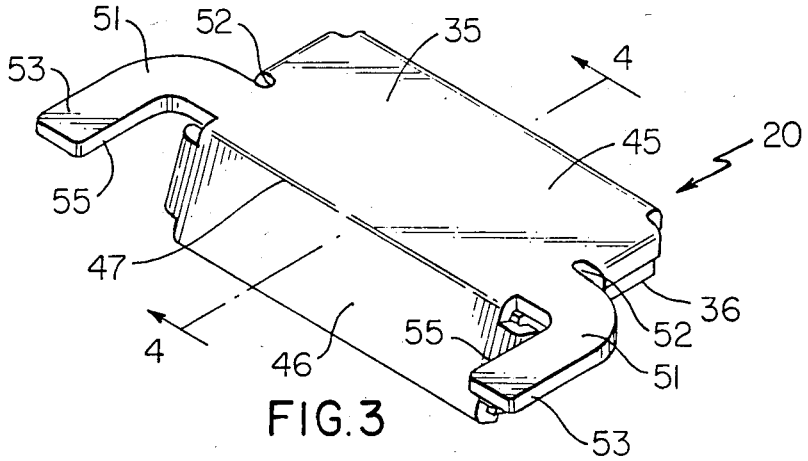
FIG. 3 is an enlarged top perpsective view illustrating the improved railroad track insulator of this invention that is utilized in FIGS. 1 and 2.
Figure 5:
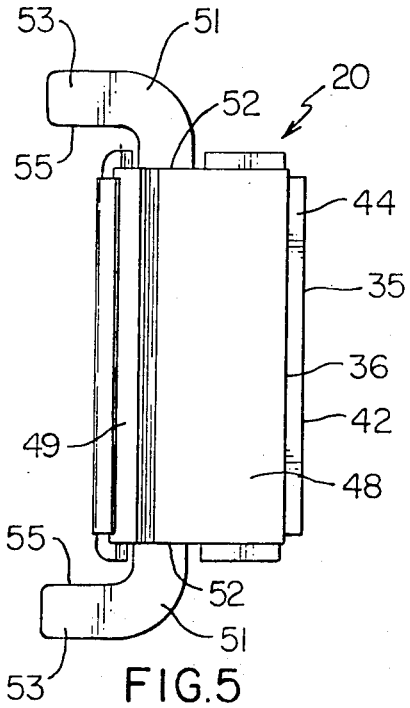
FIG. 5 is a top view of the railroad track insulator of FIG. 3.

The metallic part 35 has a pair of abutments or flanges 51 respectively extending in an L-shaped manner from the opposed ends 52 of the leg 45 thereof so that the forward portions 53 of the abutments 51 are disposed in spaced parallel relation to each other and respectively extend beyond the other leg 46 as illustrated in FIGS. 3 and 5, the abutments 51 being substantially coplanar with the leg 45.

The abutments 51 are utilized to straddle the opposed sides 54 of the block 29 of the anchoring means 27 in the manner illustrated in FIG. 2 to tend to prevent sliding movement of the track insulator 20 along the rail 21 in a manner well known in the art as the facing sides 55 of the abutments 51 will respectively engage the sides 54 of the block 29 which, of course, is stationary on the concrete means 23.

The metallic part 35 of this invention can be formed by stamping a sheet of a suitable metallic material into the configuration illustrated in the drawings.

For example, such sheet of material can be a 12 gauge cold rolled AISI 1030 steel and can be zinc coated for corrosion resistant purposes. Such metallic stamping for forming a typical insulator 20 can be approximately 3.080 of an inch between the inside surfaces 54 of the portions 53 of the abutments 51 and be approximately 1.812 of an inch between the front surfaces of the portions 53 of the abutments 51 and the rear portion of the peripheral flange 42 of the leg 45. The polymeric part 36 for such a metallic stamping 35 can comprise any suitable polymeric material, such as a glass reinforced polyester or other thermoset plastic material, such as a phenolic material. If desired, the polymeric part 36 can be formed of a thermoplastic material, such as a thermoplastic material sold under the trademark or tradename "Nylon 6/6", "Delrin" or "Zytel" by the Dupont Company of Wilmington, Del. The adhesive means for securing such a metallic part 35 and such a polymeric part 36 together can comprise and adhesive sold under the tradename or trademark "Versilok 202" by the Lord Corporation of Erie, Pa. When such a polymeric part 36 is secured to such a metallic part 35, the combined or secured together legs 45 and 48 can have a thickness between the surfaces 38 and 39 of approximately 0.390 of an inch while the thicknesses between the surfaces 38 and 39 of the cooperating legs 46 and49 would be approximately 0.315 of an inch.

However, it is to be understood that the above specific example is not to be a limitation on the claims of this invention and is merely set forth in order to provide one example of a workable embodiment.

Therefore, it can be seen that it is a relatively simple method of this invention not only to form the metallic part 35, but also to form the railroad track insulator 20 so as to operate in a manner now to be described.

As illustrated in FIG. 1, the insulator 20 is placed on the flange 30 of the track or rail 21 after the rail 21 has been disposed on the insulating pad 25 of the foundation means 22, the insulator 20 having the polymeric side 39 thereof disposed against the flange 30 of the rail 21. Thereafter, the clip 31 is assembled to the block 29 in a manner well known in the art so that the flat surface 34 thereof is urged by the resilient force of the clip 31 against the side 38 of the metallic part 35 to hold the insulator 20 against the rail 21 and thereby hold the rail 21 against the foundation means 22, the insulator 20 having been placed on the rail 21 so that the arms 51 thereof straddle the block 54 for the reasons previously set forth. In this manner, the polymeric part 36 of the insulator 20 electrically insulates the rail 22 from the clip 31 and, thus, from the anchor means 27.

While it is presently preferred to form the metallic part 35 by the aforementioned stamping operation, it is to be understood that the metallic part 35 could be formed by other methods as desired, such as by casting, forging, etc.

For example another railroad track insulator of this invention is generally indicated by the reference numeral 20A in FIGS. 9–15 and parts thereof similar to the railroad track insulator 20 previously described are indicated by like reference numerals followed by the reference letter "A".

As illustrated in FIGS. 9–13, the railroad track insulator 20A includes the metallic part 35A and polymeric part 36A secured together in the manner previously described with the metallic part 35A being formed by casting or forging and defining the legs 45A and 46A thereof. However, instead of the abutment means 51 extending from the leg 45A of the metallic part 35A, the abutments 51A extend from the leg 46A in the manner illustrated in FIGS. 9, 10 and 11 while defining spaced apart parallel inside surfaces 55A for straddling the block 29 of the anchor means 27 for the purpose previously described.

Figure 11:
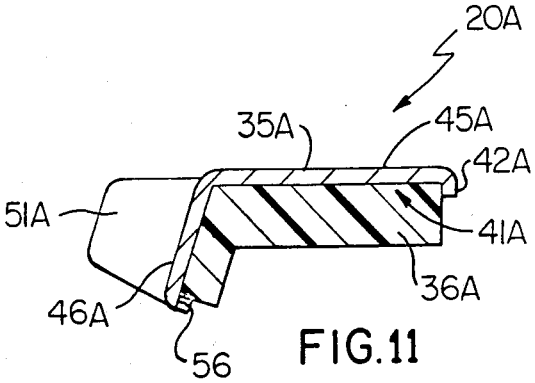
FIG. 11 is a cross-sectional view taken on line 11—11 of FIG. 10.
Figure 15:
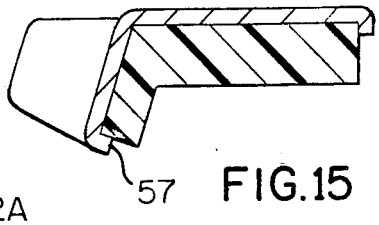
FIG. 15 is a cross-sectional view taken on line 15—15 of FIG. 14.
Figure 12:
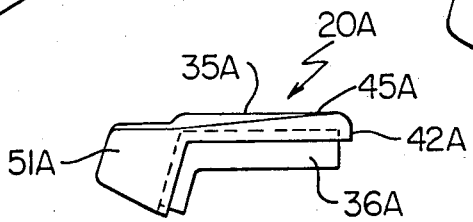
FIG. 12 is a side view of the railroad track insulator of FIG. 9.
Figure 10:
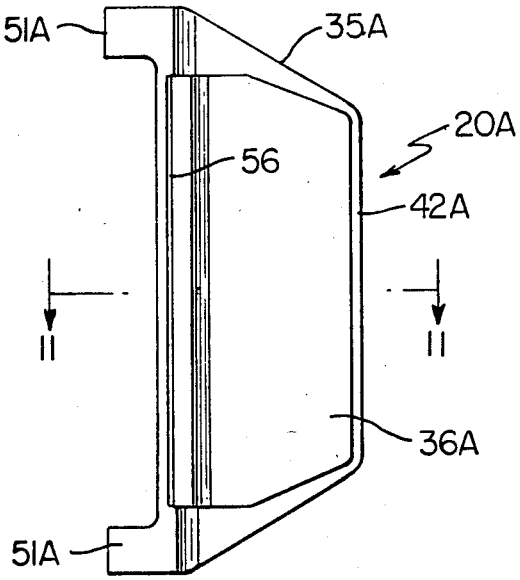
FIG. 10 is a bottom view of the railroad track insultor of FIG. 9.
Figure 14:
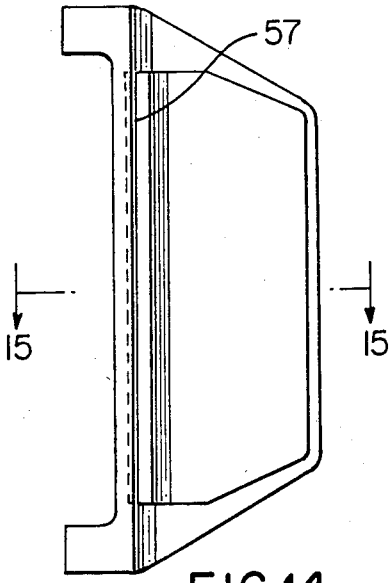
FIG. 14 is a view similar to FIG. 10 and illustrates another railroad track insulator of this invention.
Figure 13:
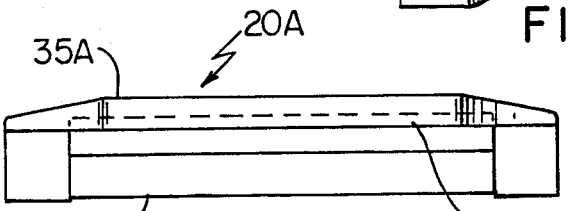
FIG. 13 is a rear view of the railroad track insulator of FIG. 9.

The metallic part 35A of the track insulator 20 has the peripheral flange means 42A extending substantially completely around the recess means 41A formed therein except that if desired, the peripheral flange means 42A can be eliminated along the forward edge 56 as illustrated in FIG. 11 or be included thereon as represented by the reference numeral 57 in FIGS. 14 and 15.

In any event, it can be seen that the railroad track insulator 20A illustrated in FIGS. 9–15 can be made to function in substantially the same manner as the railroad track insulator 20 previously described whereby the method of making and the method of operation of the insulator 20A need not be repeated.

As previously stated, while any suitable material can be utilized to form the metallic part 35A for the insulator 20A, it has been found that when the same comprises a casting, the metallic part 35A can be made from AISI-1020 steel while the polymeric part 36A can be formed of the same material previously described for the polymeric part 36 and be secured to the metallic part 35A by the previously described adhesive.

Therefore, it can be seen that this invention not only provides an improved railroad insulator and method of making the same, but also this invention provides an improved metallic part for such an insulator or the like.

While the forms and methods of this invention now preferred have been illustrated and described as required by the Patent Statute, it is to be understood that other forms and method steps can be utilized and still fall within the scope of the appended claims.

What is claimed is:

1. In a method of making a railroad track insulator for holding a railroad rail against its foundation means and comprising the steps of securing a generally L-shaped configuration metallic part and a generally L-shaped configuration polymeric part together so that the polymeric part is adapted to engage said rail, forming said metallic part to have an open side recess means in one of the opposide sides thereof with said recess means being defined by a peripheral flange means on each edge thereof, and disposing and securing said polymeric part in said recess means so as to have a peripheral edge means thereof supported by said peripheral flange means of said metallic part, the improvement wherein said step of forming said metallic part comprises the step of stamping a sheet of metallic material to bend same into such a configuration.

2. A method of making a railroad track insulator as set forth in claim 1 wherein said step of disposing said polymeric part causes one of the opposed sides thereof to be disposed against said one side of said metallic part.

3. A method of making a railroad track insulator as set forth in claim 2 wherein said step of securing comprises the step of securing said one side of said polymeric part to said one side of said metallic part with adhesive means.

4. A method of making a railroad track insulator as set forth in claim 2 and including the step of forming said peripheral flange means to have an end surface means that is disposed intermediate said opposed sides of said polymeric part whereby the other of said sides of said polymeric part is disposed spaced from said end surface means.

5. A method of making a railroad track insulator as set forth in claim 2 and including the step of forming said metallic part to have a generally L-shaped cross-sectional configuration that defines two legs thereof being disposed at an angle relative to each other.

6. A method of making a railroad track insulator as set forth in claim 5 and including the step of forming said polymeric part to have a generally L-shaped cross-sectional configuration that defines two legs thereof being disposed at an angle relative to each other and generally following the profile of said legs of said metallic part.

7. A method of making a railroad track insulator as set forth in claim 5 wherein one of said legs of said metallic part is adapted to be engaged by a clip of an anchoring member and including the step of forming a pair of spaced apart abutments to extend from said one leg to receive a block of said anchoring member therebetween to tend to prevent sliding movement of said insulator along said rail.

* * * * *